United States Patent [19]

Cochran et al.

[11] Patent Number: 4,459,839

[45] Date of Patent: Jul. 17, 1984

[54] CRIMPING TOOL

[75] Inventors: Charles D. Cochran; Michael S. Clardy; William B. Kroske, all of Greenville, S.C.

[73] Assignee: FTZ Industries, Inc., Simpsonville, S.C.

[21] Appl. No.: 310,460

[22] Filed: Oct. 13, 1981

[51] Int. Cl.[3] ..... B21D 7/06

[52] U.S. Cl. ..... 72/412; 72/32; 72/454

[58] Field of Search ..... 72/412, 454, 410, 389, 72/448, 32; 59/7

[56] References Cited

U.S. PATENT DOCUMENTS

| | | | |
|---|---|---|---|
| 2,116,952 | 5/1938 | Nystrom | 72/454 |
| 2,712,252 | 7/1955 | Landis | 72/413 |
| 2,744,429 | 5/1956 | Seely | 72/412 |
| 2,762,414 | 9/1956 | Demler | 72/414 |
| 2,772,715 | 12/1956 | Neijstrom | 72/473 |
| 2,837,135 | 6/1958 | Demler | 72/477 |
| 3,316,744 | 5/1967 | Spangler | 72/35 |
| 3,576,122 | 4/1971 | Churla | 72/413 |
| 4,019,362 | 4/1977 | McKeever | 72/421 |
| 4,117,711 | 10/1978 | Medcraft | 72/477 |
| 4,118,971 | 10/1978 | Izraeli | 72/413 |
| 4,192,171 | 3/1980 | Hamilton | 72/416 |

FOREIGN PATENT DOCUMENTS

| | | | |
|---|---|---|---|
| 8033 | of 1910 | United Kingdom | 72/454 |

*Primary Examiner*—Gene P. Crosby
*Attorney, Agent, or Firm*—Bailey & Hardaway

[57] ABSTRACT

A crimping tool having an adjustable anvil and a crimp pin movable toward the anvil has means for limiting the movement of the crimp pin toward the anvil.

14 Claims, 7 Drawing Figures

FIG. 1
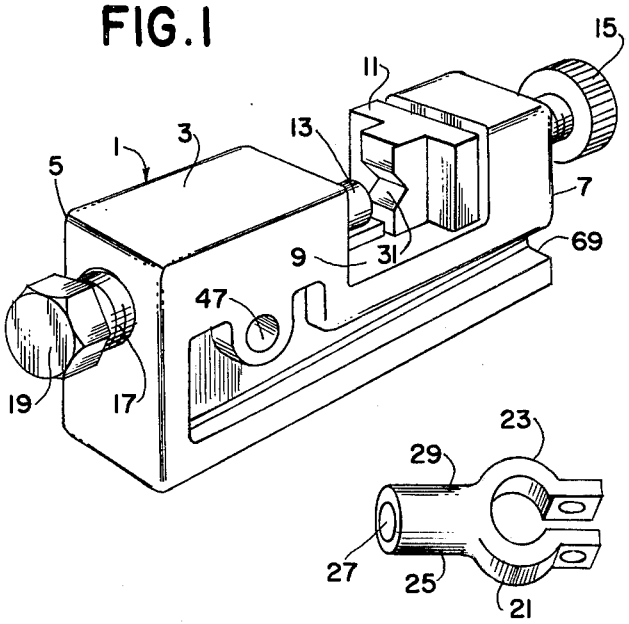
FIG. 2
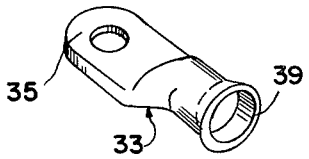
FIG. 3
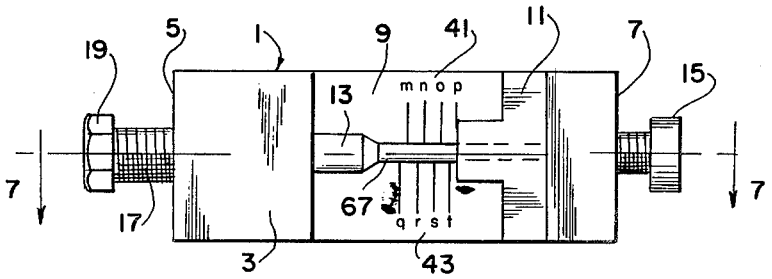
FIG. 4

FIG. 5
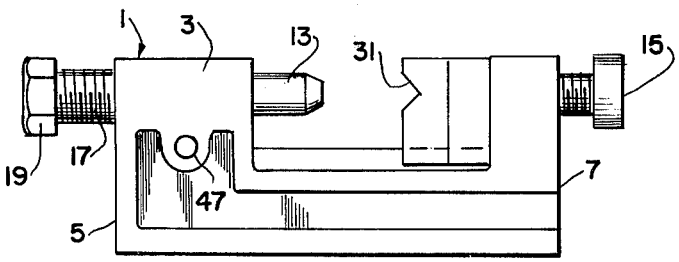
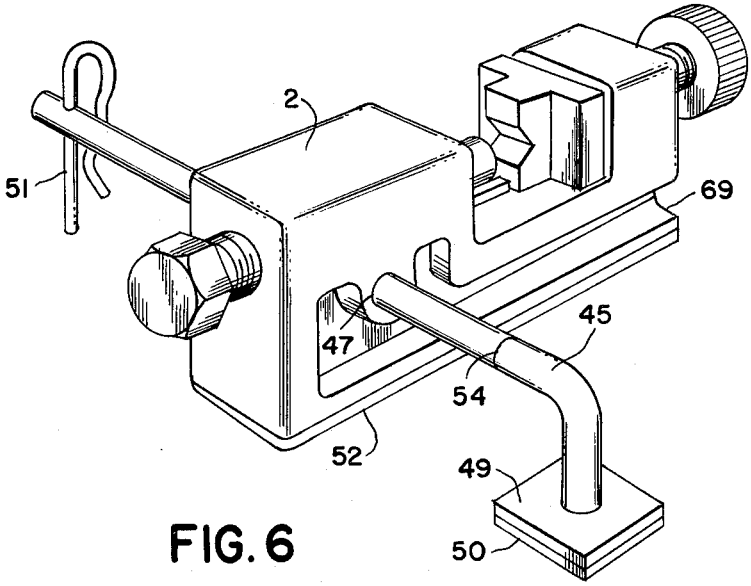
FIG. 6
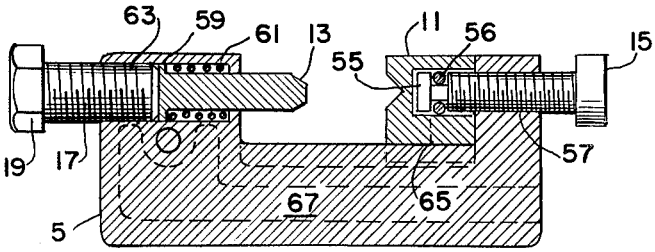
FIG. 7

CRIMPING TOOL

BACKGROUND OF THE INVENTION

This invention relates generally to the art of electrical connections, and more particularly to an apparatus for crimping electrical connectors to wires or cables.

Various means exist within the prior art for applying electrical connectors to various sizes of wires and cables. One apparatus utilized in the prior art is for the purpose of producing and providing wires with connectors. Such a device is described in U.S. Pat. No. 4,019,362. The apparatus is generally a stationary device which mass produces connectors or terminals crimped about a conductor.

Other crimping devices are generally portable being adapted for use in replacing or reapplying connectors or terminals to an electrical conductor. Such devices generally provide for versatility in the size of terminal and wire to be received for the crimping operation. Several such devices utilize lever or pump action with variable sizes of crimping dies. Such devices are disclosed in U.S. Pat. Nos. 2,772,715 to Neijstrom et al; U.S. Pat. No. 2,762,414 to Demler; U.S. Pat. No. 2,712,252 to Landis; U.S. Pat. No. 4,118,971 to Izraeli; U.S. Pat. No. 2,837,135 to Demler; U.S. Pat. No. 3,576,122 to Churia.

Various impact devices also exist within the realm of the prior art for portable use. Such impact devices comprise an anvil with an overlying impact pin. The impact pin is provided with a marker and corresponding indicia to indicate the appropriate depth of impact for standard of connectors or terminals. Such impact devices are disclosed in U.S. Pat. No. 3,316,744 to Spangler and U.S. Pat. No. 4,117,711 to Medcraft. These impact devices are generally operated by utilizing a hammer or a bench vise in order to produce crimping of a connector or terminal about a conductor. Such tools are generally adaptable for use on a work bench.

Of the portable crimping devices discussed above, all have been developed to function in a broad area of use. Such devices of necessity have not been specifically adapted for a narrow area of repetitive use, for example, use within the automotive and truck vehicle maintenance area. Within the automotive and particularly truck maintenance areas, it is necessary to periodically replace connectors or terminals throughout the electrical system for such vehicles. Of particular need for such maintenance are battery terminals, i.e., the connector which is crimped on one end to an electrical conductor and on the other to a battery post. Another area within such vehicles which is in need of frequent maintenance is the starter lug which must be frequently replaced. In the past, mechanics have found it necessary to utilize cumbersome lever type devices within the confines of a hood, engine compartment or battery box. Not only are such lever type devices cumbersome in such an environment, but also expensive due to the precision machinery of the variable size dies.

Impact devices have also been utilized in the vehicle maintenance areas. With impact devices, however, it is frequently necessary to totally remove the conductors from the vehicle in order to utilize the impact device upon a work bench. As an alternative mechanics are frequently forced to attempt to utilize the impact device within the limited space available within the vehicle maintenance area. The shortcomings of utilizing an impact device within an area not designed for such are apparent.

SUMMARY OF THE INVENTION

It is thus an object of this invention to provide a novel crimping tool.

It is a further and more particular object of this invention to provide a novel crimping tool specifically adapted for use in the maintenance of automotive and truck vehicles.

These as well as other objects are accomplished by a crimping tool having a work area between an adjustable anvil, a crimp pin movable toward and away from the anvil and means for limiting the movement of the crimp pin toward the anvil.

BRIEF DESCRIPTION OF THE DRAWINGS

FIG. 1 of the drawing is a perspective view of a crimping tool in accordance with this invention.

FIG. 2 of the drawings illustrates a battery terminal for crimping in accordance with this invention.

FIG. 3 of the drawings represents a starter lug which may be crimped utilizing the crimping tool of this invention.

FIG. 4 of the drawings illustrates an elevated view of the crimping tool in accordance with this invention.

FIG. 5 of the drawings illustrates a front view of the crimping tool of this invention.

FIG. 6 of the drawings illustrates the crimping tool of this invention including an anti-torque arm.

FIG. 7 of the drawings is a view along the line 7—7 of FIG. 4.

DETAILED DESCRIPTION

In accordance with this invention, it has been found that a novel crimping tool having an adjustable anvil, a crimp pin movable toward and away from the anvil, and means for limiting the movement of the crimp pin toward the anvil offers versatile crimping capabilities in remote and confined areas. Various advantages and features will become apparent from the following description given with reference to the various FIGURES of drawing.

FIG. 1 of the drawing illustrates a perspective view of a crimping tool in accordance with this invention. The crimping tool 1 comprises a body portion 3 with a proximal end 5 and a distal end 7. Between the proximal end 5 and distal end 7 the body portion 3 defines a working section 9. Within the working section 9 are an adjustable anvil 11 and a crimp pin 13.

Anvil 11 is adjustable toward and away from the distal end by rotation of anvil screw 15. Thus anvil 11 may be moved to any desired location within the working section as is permitted by the movement of anvil screw 15. In a like manner, crimp pin 13 is movable toward and away from anvil 11. Crimp pin 13 is actuated into movement by rotation of power screw 17. The movement of crimp pin 13, however, by power screw 17 is limited by the enlarged head portion 19 which is in communication with the power screw 17 and bottoms against proximal end 5. Thus the enlarged head portion 19 is a means for limiting the movement of crimp pin 13 toward anvil 11.

The desired operation of the crimping device is carried out by locating anvil 11 at a position within working section 9 such that the space remaining between the limited end movement of crimp pin 13 and the anvil is of the desired spacing to be achieved when a terminal or connector has been crimped. Thus, the crimping operation is carried out by the first setting the desired anvil location having power screw 17 rotated so as to leave sufficient space for a terminal or connector to be placed therebetween. The terminal or connector with the conductor appropriately placed in relationship to the connector is rested upon the anvil 11. Power screw 17 is then rotated until the movement limiting means permits no further movement of the crimp pin toward the anvil. The terminal is thus appropriately crimped and ready for removal from the crimping tool. The crimp terminal is removed by retracting the crimp pin 13 by rotation of power screw 17 in the reverse direction. Further description of the preferred operation of power screw 17 is given below.

A typical connector to be utilized within crimping tool 1 is illustrated in FIG. 2 of the drawings wherein a connector in the form of a battery terminal 21 is illustrated. The terminal 21 comprises two functional components. The annular portion 23 is for mounting upon a battery post while the connection portion 25 is for receiving and being crimped about a cable. After receipt of a cable, the connection portion 25 is crimped about the cable in order to complete a durable and permanent connection.

The connecting portion 25 comprises a hollow conductor receiving volume 27 which extends toward annular portion 23 and terminates at 29. It is desirable that only the portion between 29 and the beginning of volume 27 be involved in the crimping step since any attempt to crimp the portion between 29 and the annular battery post engaging section 23 results in fracture of the terminal due to the inability of the solid area to compress.

For this reason, anvil 11 is desirably shaped for receipt of such a terminal so that only the desired crimping portion rests within the jaw 31 of anvil 11 as best seen in FIGS. 1 and 5.

This may be achieved by shaping the jaw 31 so that annular portion 23 rests against a limiting surface to expose only the volume between 29 and the opening of conductor receiving volume 27 to the crimping force brought about by the movement of crimp pin 13 toward anvil 11.

An alternative structure for bringing about this desired result is to provide an asymmetrical jaw for receipt of the desired crimping portion only. It is preferred however to utilize a symetrical structure as illustrated in order that the tool be useable in both the left and right handed mode.

FIG. 3 of the drawings illustrates another connector which is envisioned to be within the scope of operation of the crimping tool of this invention. Illustrated in FIG. 3 of the drawings is a starter lug 33 having a starter engaging portion 35 and a conductor receiving section 39. In a like manner, it is desirable that only the conductor engaging hollow portion of section 39 be crimped about a conductor during the crimping process. Conductors having sizes in the A.W.G. system numbered from 8 to 4/0 are useable with the crimping tool of this invention for various connectors, including battery terminals and starter lugs. The crimping tool of this invention has provision for accurately and precisely crimping connectors about various sized conductors by appropriately adjusting the position of anvil 11. Such adjustment is described in conjunction with FIG. 4 of the drawings.

FIG. 4 of the drawings illustrates a plan view of crimping tool 1. Illustrated in the plan view are indicia 41 upon which the anvil 11 may be located in order to select an appropriate spacing for the crimping operation. As an alternate feature of this invention, indicia 41 on one side of working setion 9 may designate appropriate positions for crimping a battery terminal while indicia 43 on the opposite side may indicate appropriate positions for crimping another type connector, such as a starter lug. Indicia may also be located on the side at portion 3 or a plate thereon to align with anvil position. Direction may also be included along with any indicia.

The overall size of the crimping tool is of a convenient size to be readily operable within the confined spaces of an automobile or truck vehicle or a conventional tool box. Such convenient size may comprise for the body portion a distance of approximately 6 to 8 inches with a width of 1½to 3 inches with a height of approximately 2 to 3 inches. It is readily apparent that with such dimensions the overall crimping tool is readily useable within the confines of a hood area of a vehicle, the starter area, even from above or below the vehicle, or within a battery box located at remote areas on the cab of a large truck.

A preferred aspect of this invention comprises the use of the crimping tool in combination with an air actuated wrench. For this reason, it is preferred that movement limiting means 19 be a hexagonal 1⅛ or 1¼ inch head for use with an air activated wrench. Such air wrenches conventionally operate at a torque which is sufficient to perform the desired crimping operation without deleteriously affecting the crimping tool components. The operational torque of such a wrench is not an essential aspect of this invention since the degree of crimping is controlled by movement limiting means 19 rather than by the applied torque. However, it is understood that power screw 17 may be rotated by other conventional means such as a hand wrench or socket set.

In order to minimize any rotation of the body portion of the crimping tool 1 brought about by movement of power screw 17 it is preferred to provide the crimp tool with an anti-torque arm shown in FIG. 6 as 45. Anti-torque arm 45 extends in a direction generally perpendicular to the direction defined between the proximal end 5 and distal end 7 of body portion 3. Body portion 3 defines a cavity 47 through which anti-torque arm 45 slidaly passes from either direction through cavity 47 best seen in FIGS. 5 and 6 to stabilize the crimping tool during the application thereto of a torque to rotate power screw 17. Anti-torque arm 45 is functional to stabilize the crimping tool for either left or right hand use and during actuation and reversal of power screw 17. Anti-torque arm 45 is preferably equipped with an insulated block 49 and pad 50 in order to prevent the completion of a circuit while operating in the battery area. As an optional feature, the entire torque arm may be fabricated of an insulating material or covered with an insulating material. An insulating pad 52 is shown on the bottom of crimping tool 1 in the FIG. 6 illustration. Additionally an insulating coating may external from the block 49 to a convenient location 54 on arm 45 to further minimize electrical hazards. Anti-torque arm 45 may be formed of fiberglass, but is preferably formed of steel with an insulating coating thereon as illustrated at 54. Anti-torque arm is preferably provided with means 51 such as a cinch pin to prevent unintentional dislodgement of the anti-torque arm during use of the crimping tool.

Having generally set forth the crimping tool of this invention and its method of use, further details will be given with reference to FIG. 7 of the drawings, which is a cross section along line 7—7 of FIG. 4. As is seen therein, anvil screw 15 rotates in a cavity 55 defined by anvil 11 in order to permit appropriate location of the anvil 11. Retaining pins 56 pass through anvil 11 to maintain anvil screw 15 rotatably in communication with anvil 15. Anvil screw 15 produces movement by rotating through threaded cavity 57 defined by body portion 3. Crimp pin 13 preferably communicates with power screw 17 so as to minimize any rotational effects on crimp pin 13. For this reason, crimp pin 13 has an flanged end portion 59 which confines resilient urging means 61 which biases crimp pin 13 toward the proximal end 5. Thus upon retraction of power screw 17 crimp pin 13 also retracts by virtue of the action of resilient urging means 61. Resilient urging means 61 is illustrated in FIG. 7 as a spring. Power screw 17 moves abuts crimp pin 13 with a sliding polished and lubricated surface. Power screw 17 moves through body portion 3 by virtue of threaded cavity 63 defined thereby.

For purposes of stabilizing anvil 11, it is preferred that the anvil comprise a recess 65 which rides a rail 67 defined in the body portion 3. It is also preferred that the crimp pin have a taper toward the distal end for purposes of adding strength and stability to the crimp pin due to the rigors associated with the crimping process and to reduce the power needed for crimping. The end of crimp 13 may be channelled in order to prevent crimping from rotating in contact with a terminal.

An optional feature of the crimping tool in accordance with this invention is the provision of a lateral slot 69 on either lateral side of the body portion which permits the body portion to be received within a C-shaped clamp or wedge track on a work bench. With this aspect of the invention in mind, it is preferred that the entire body portion have a slight taper, e.g., two percent, from the proximal end toward the distal end in order to permit the body portion to be slideably lodged within a C-shaped clamp.

It is thus seen that this invention provides a novel crimping tool for general use and specifically provides a novel device and process for crimping electrical connectors utilized in automotive and truck vehicles. Having set forth this invention and the preferred embodiments thereof, many variations thereof will become apparent to those in the art. Such variations, however, are within the scope of this invention as is defined by the following appended claims.

That which is claimed is:

1. A crimping tool, comprising:

a body portion, said body portion having a proximal end and a distal end and defining between said proximal end and said distal end a working section, said body portion defining a threaded cavity near said proximal end;

an adjustable anvil movable within said working section from a position located closer to said distal end than said proximal end;

a crimp pin movable within said working section toward and away from said anvil from a position located closer to said proximal end than said distal end; and a power screw with an enlarged head portion threadedly engaged within said threaded cavity, said enlarged head portion capable of bottoming against said proximal end when said crimp pin has reached the full extent of its movement toward said anvil and thus limits the movement of said crimped pin toward said anvil.

2. The crimping tool in accordance with claim 1 comprising indicia on said body portion for locating said anvil at a predetermined location within said working section.

3. The crimping tool in accordance with claim 1 wherein said body portion defines near its distal end a threaded cavity for receiving an anvil screw therethrough for adjusting said anvil.

4. The crimping tool in accordance with claim 1 comprising indicia on said body portion to indicate a predetermined location for said anvil to produce a desired degree of crimping when said crimp pin has reached the limit of its movement toward said anvil.

5. The crimping tool in accordance with claim 1 further comprising an anti-torque arm extendable from said body portion in a direction substantially perpendicular to the direction defined by and extending from said proximal end to said distal end to stabilize said body portion from the torque created by rotation of said power screw.

6. The crimping tool in accordance with claim 7 wherein said body portion defines a cavity for receiving said anti-torque arm.

7. The crimping tool according to claim 1 wherein said body portion defines a recess across said working section and said anvil comprises a leg for riding in said recess.

8. The crimping tool in accordance with claim 1 wherein said threaded cavity for said power screw communicates with a non-threaded cavity defined by said body portion and wherein means for resiliently urging said crimp pin toward said proximal end reside within said non-threaded cavity.

9. The crimping tool in accordance with claim 8 wherein said means for resiliently urging comprises a spring concentrically mounted about said crimp pin and in communication therewith.

10. The crimping tool in accordance with claim 1 wherein said body portion tapers from said proximal end toward said distal end and defines lateral slots for receipt of mounting means.

11. The crimping tool in accordance with claim 1 wherein said crimp pin tapers in the direction toward said distal end.

12. The crimping tool in accordance with claim 1 wherein said anvil defines along the surface said crimp pin an article locating means for positioning an item to be crimped in a predetermined manner.

13. The crimping tool in accordance with claim 1 wherein said anvil is asymmetrically located in said working section to define a predetermined location for receipt of an item to be crimped.

14. A crimping tool, comprising:

a body portion, said body portion having a proximal end and a distal end and defining between said proximal end and said distal end a working section said body portion tapering from said proximal end toward said distal end and defines lateral slots for receipt of mounting means;

an adjustable anvil movable within said working section from a position located closer to said distal end than said proximal end;

a crimp pin movable within said working section toward and away from said anvil from a position located closer to said proximal end than said distal end; and means for limiting the movement of said crimp pin toward said anvil.

* * * * *